US005705896A

United States Patent [19]

Choi

[11] Patent Number: 5,705,896

[45] Date of Patent: Jan. 6, 1998

[54] CONTROL ELECTRONIC BALLAST SYSTEM USING FEEDBACK

[75] Inventor: Nak Choon Choi, Kyonggi-do, Rep. of Korea

[73] Assignee: Samsung Electronics Co., Ltd., Suwon, Rep. of Korea

[21] Appl. No.: 619,237

[22] Filed: Mar. 21, 1996

[30] Foreign Application Priority Data

Mar. 30, 1995 [KR] Rep. of Korea ..... 95-7119

[51] Int. Cl.[6] ..... G05F 1/00

[52] U.S. Cl. ..... 315/307; 315/176; 315/224; 315/209 R

[58] Field of Search ..... 315/175, 176, 315/224, 227 R, 209 R, 237, 291, 297, 307, 360, 197–199

[56] References Cited

U.S. PATENT DOCUMENTS

| | | | |
|---|---|---|---|
| 4,180,852 | 12/1979 | Koizumi et al. | 363/49 |
| 4,598,351 | 7/1986 | Fair et al. | 363/49 |
| 5,015,921 | 5/1991 | Carlson et al. | 315/208 |
| 5,030,887 | 7/1991 | Guisinger | 315/158 |
| 5,041,763 | 8/1991 | Sullivan et al. | 315/176 |
| 5,315,214 | 5/1994 | Lesea | 315/209 R |

*Primary Examiner*—Robert Pascal
*Assistant Examiner*—Haissa Philogene
*Attorney, Agent, or Firm*—Cushman Darby & Cushman IP Group of Pillsbury Madison & Sutro LLP

[57] ABSTRACT

A feedback control system for electronic ballast comprises a lamp, an electronic ballast, a multiplier, a time controller, a first adder-subtracter, a reference voltage generator, a second adder-subtracter, an error amplifier, a capacitor, a voltage controlled current source VCCS, a third adder-subtracter and an oscilloscope and output driver.

5 Claims, 5 Drawing Sheets

CONTROL ELECTRONIC BALLAST SYSTEM USING FEEDBACK

BACKGROUND OF THE INVENTION

A. Field of the Invention

The present invention relates to a feedback control system for an electronic ballast. More particularly, the present invention relates to a feedback control system for an electronic ballast which can stably control the frequency for preheating the lamp, temporary lamp discharge, and maintenance of lamp discharge, in spite of irregular characteristics of lamp load.

B. Description of Related Art

Generally, a conventional feedback control system for an electronic ballast has many advantages: feedback can be stably controlled despite irregular characteristics of lamp load, energy can be saved, and the lamp life can be extended.

Preheating is used to heat the lamp filament at a proper temperature so that the lamp is not stressed when discharged. Preheating can be performed by supplying the lamp with limited and controlled current.

The conventional feedback control system for an electronic ballast will be described in detail with reference to the accompanying drawing.

FIG. 1 is a block diagram of a conventional feedback control system for an electronic ballast.

As shown in FIG. 1, in the conventional feedback control system, direct-current (DC) link voltage E and current ifb, from electronic ballast 12 used for controlling current which lamp 11 consumes, are fed back to multiplier 13, and multiplier 13 combines the DC link voltage E and the current ifb. A signal derived from multiplier 13 is voltage Vmo sent through resistor block Rmo. A first adder-subtracter 15 adds or subtracts voltage Vmo based on reference voltage Vref produced from reference voltage generator 14 for determining input voltage to electronic ballast 12.

Added or subtracted voltage Verr produced from first adder-subtracter 15 is amplified up to current Iin through an error amplifier 16 having transconductance Gm.

The amplified current Iin is integrated to voltage Vin by capacitor C. The voltage Vin is converted to current I1 through voltage controlled current source VCCS 17. A second adder-subtracter 18 adds the current I1, current Ie fed forward from DC link voltage E from electronic ballast 12, and reference current Iref.

Total current (it) is charged to capacitor Ct in an oscillator and output driver 19, such that control frequency f1 for electronic ballast 12 is determined.

The frequency f1 determines the input voltage to electronic ballast 12, and the determined input voltage is proportional to current ifb, thereby making feedback control possible.

However, in the conventional feedback control system for an electronic ballast, it is possible to maintain a discharge state after discharging the lamp, but it is difficult to preheat the lamp. For example, power required by the electronic ballast during a lamp preheating period should be one tenth the power required during a discharge maintaining period. In addition, it is difficult to prevent inrush-current and an increase of voltage when the discharging has just started because discharging is not under proper control.

SUMMARY OF THE INVENTION

The present invention overcomes the problems and disadvantages of the prior art by providing a feedback control system for an electronic ballast which can stably control preheating frequency, temporary discharge, and discharge maintenance of a lamp, in spite of irregular characteristics of lamp load.

To achieve the objects and in accordance with the purpose of the invention, as embodied and broadly described herein, the feedback control system for electronic ballast comprises a lamp which is an object to be controlled; an electronic ballast for producing signals for preheating, temporary discharging, and discharge maintaining of the lamp, and producing direct-current (DC) link voltage signals, for feedback controlling; a multiplier for receiving signals which are the DC link voltage produced from the electronic ballast and producing a value proportional to multiplication of two signals, the DC link voltage; a time controller for producing a signal proportional to time according to a preheating period and a discharge period of the lamp, a soft start controller for receiving the signal from the time controller and producing signals for the preheating period and the discharge period of the lamp; a first adder-subtracter for adding or subtracting an output signal imo from the multiplier and an output signal from the soft start controller; a reference voltage generator for producing voltage which is reference voltage for determining input voltage to the electronic ballast in the feedback control; a second adder-subtracter for adding or subtracting a signal produced from the first adder-subtracter, passing through a resistor block and inputted, and the output signal from the reference voltage generator; an error amplifier for amplifying an output signal from the second adder-subtracter; a capacitor for integrating current produced from the error amplifier and changing it into voltage; a voltage controlled current source VCCS for receiving voltage from the capacitor and converting it into current; a third adder-subtracter for adding or subtracting output current from the VCCS, reference current, and a signal produced from the electronic ballast and passing through a resistor; and an oscilloscope and output driver with an internal capacitor to which output current from the third adder-subtracter is charged, thereby determining control frequency for producing to the electronic ballast.

As described above, feedback can be controlled stably in spite of irregular lamp load characteristics, energy can be saved and the life of the lamp can be extended by providing the feedback control system for electronic ballast which can control stably the frequency for preheating, temporary discharge and discharge maintenance of the lamp.

Additional objects and advantages of the invention will be set forth in part in the description which follows, and will be clear from the description. The objects and advantages of the invention will be realized and attained by means of the elements and combinations particularly pointed out in the appended claims.

BRIEF DESCRIPTION OF THE DRAWINGS

The accompanying drawings illustrate embodiments of the invention and, together with the description, serve to explain the principles of the invention. In the drawings.

DESCRIPTION OF THE PREFERRED EMBODIMENT

Reference will now be made in detail to a preferred embodiment of the present invention, an example of which is illustrated in the accompanying drawings. Wherever possible, the same reference numbers will be used throughout the drawings to refer to the same or like parts.

Figure 3:
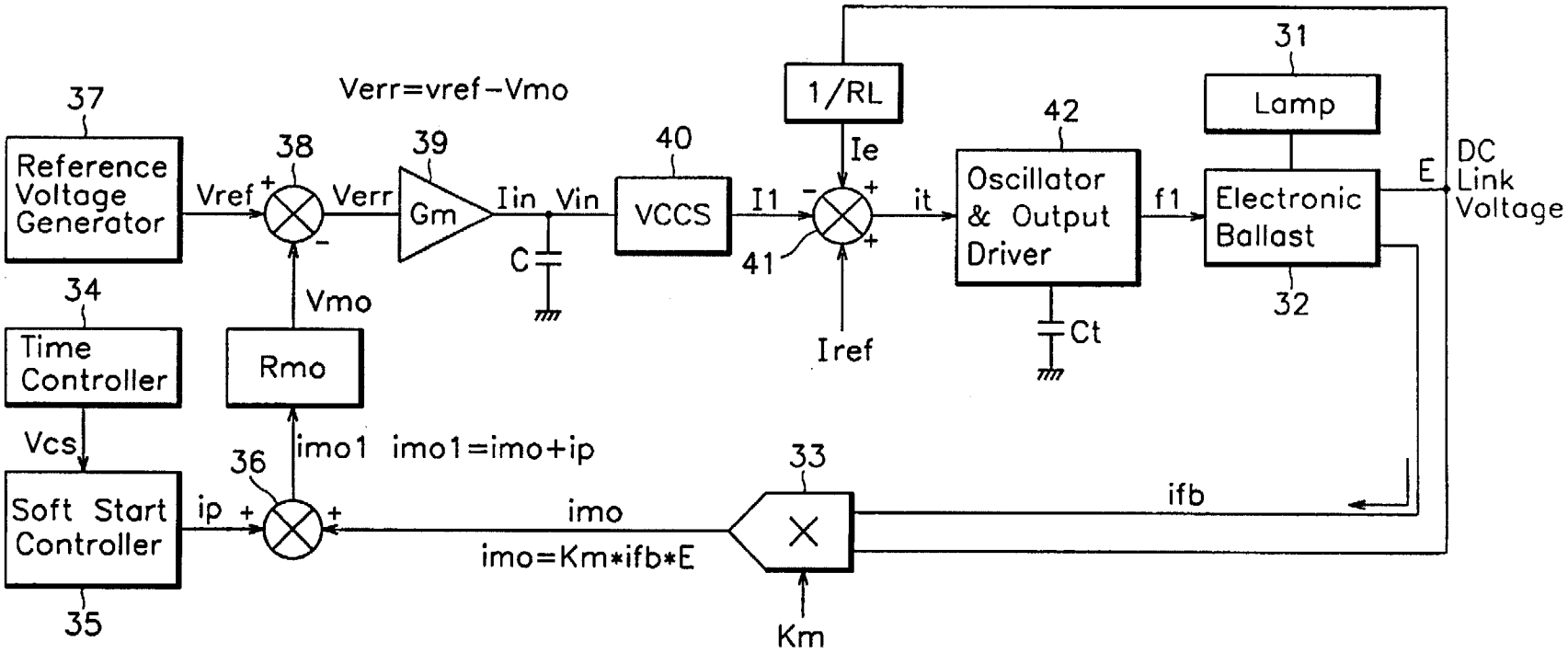
FIG. 3 is a block diagram illustrating a feedback control system according to the preferred embodiment of the present invention.

FIG. 3 is a block diagram illustrating a feedback control system according to the preferred embodiment of the present invention.

As shown in FIG. 3, a feedback control system for an electronic ballast, according to the preferred embodiment of the present invention, includes lamp 31 which is to be controlled, electronic ballast 32 for producing signals for preheating, temporary discharge and maintained discharge of the lamp, and producing direct-current (DC) link voltage E and current ifb for controlling feedback. A multiplier 33 receives DC link voltage E and current ifb, produced from electronic ballast 32, and produces a value proportional to the multiplication of DC link voltage E and current ifb. A time controller 34 produces a signal Vcs proportional to the time of a preheating period and a discharge period of lamp 31. A soft start controller 35 receives signal Vcs from time controller 34 and produces signals for the preheating period and the discharge period of lamp 31. A first adder-subtracter 36 adds or subtracts an output signal imo from multiplier 33 and an output signal ip from soft start controller 35. A reference voltage generator 37 produces voltage Vref which is a reference voltage for determining input voltage to electronic ballast 32 in the feedback control. A second adder-subtracter 38 adds or subtracts signal Vmo produced from first adder-subtracter 36 and resistor block Rmo, and output signal Vref from reference voltage generator 37. An error amplifier 39 amplifies output signal Verr from second adder-subtracter 38. A capacitor C integrates current Iin, output from error amplifier 39, and changes it into voltage Vin. A voltage controlled current source VCCS 40 receives voltage Vin from capacitor C and converts it into current I1. A third adder-subtracter 41 adds or subtracts output current I1, from VCCS 40, reference current Iref, and signal ie produced from electronic ballast 32 and resistor 1/RL. An oscillator and output driver 42 with internal capacitor Ct is supplied by output current (it) from third adder-subtracter 41 thereby determining control frequency f1 to be sent to electronic ballast 32.

Figure 4:
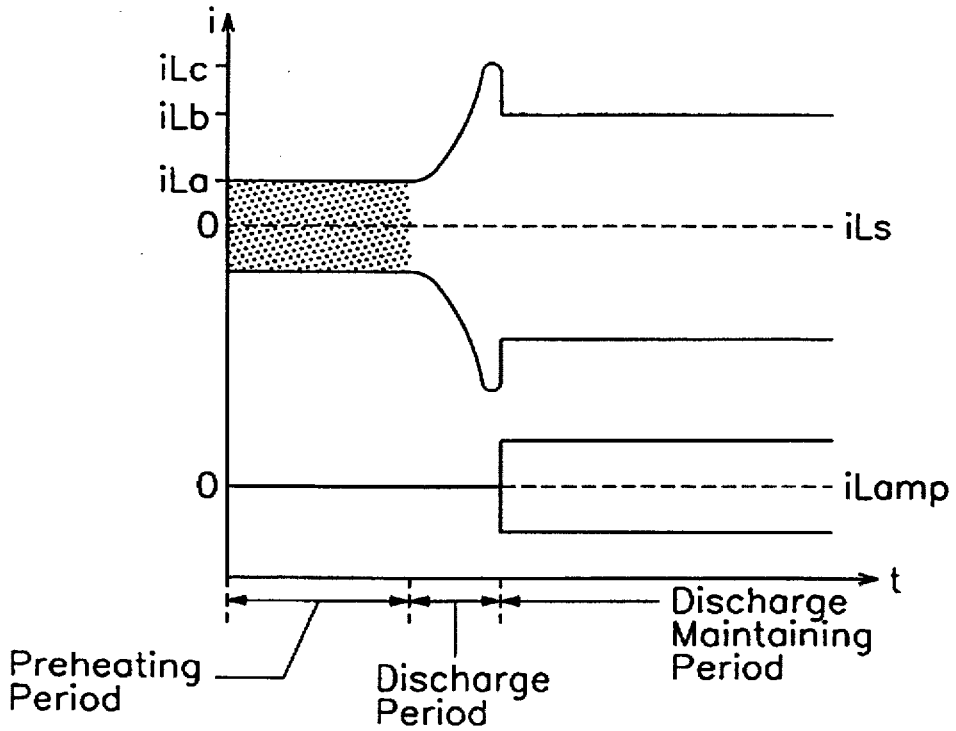
FIG. 4 is a waveform chart illustrating resonant current and lamp current soft-started from a preheating period to a discharge maintaining period of a lamp by compulsory control of frequency in an open-loop state, according to the preferred embodiment of the present invention.

FIG. 4 is a waveform chart illustrating resonant current and lamp current soft-started from a preheating period to a discharge maintaining period by compulsory control of frequency in an open-loop state, according to the preferred embodiment of the present invention.

Figure 5:
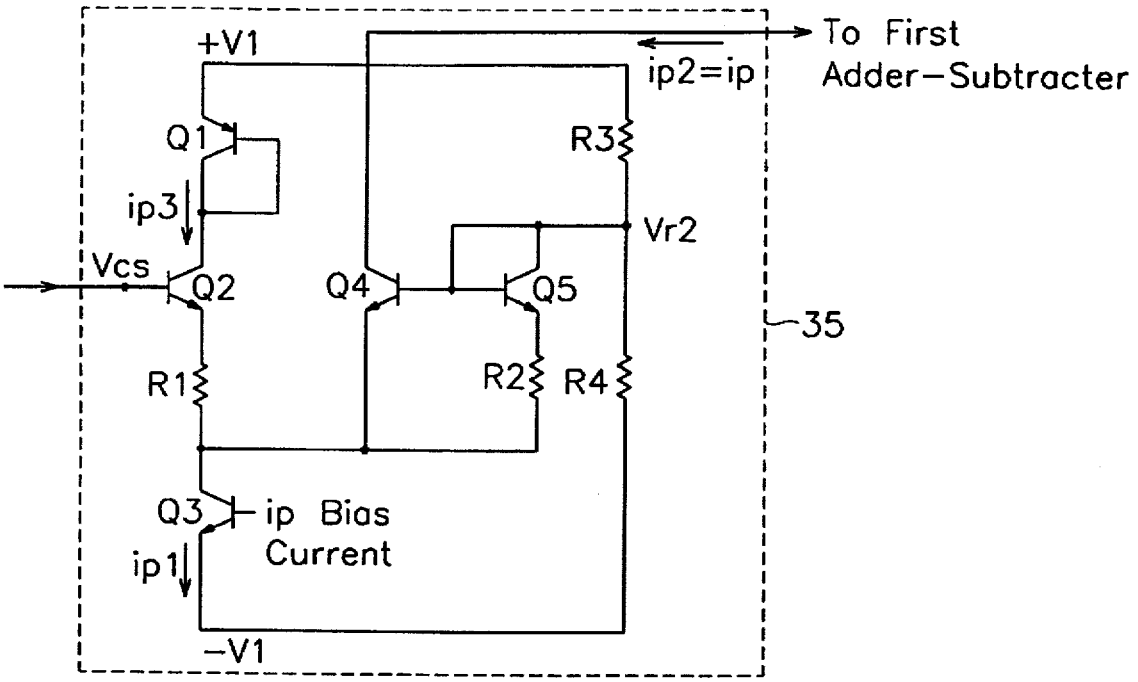
FIG. 5 is a circuit diagram illustrating a soft start controller in a feedback control system according to the preferred embodiment of the present invention.

As shown in FIG. 5, a soft start controller in the feedback control system includes second transistor Q2 with a base terminal which receives an output signal Vcs from time controller 34 (see FIG. 3). A first resistor R1 has a first terminal connected to an emitter terminal of second transistor Q2. A third transistor Q3 has a collector terminal connected to a second terminal of first resistor R1, a base terminal which receives bias current ip and an emitter terminal for producing current ip1. A fourth transistor Q4 has an emitter terminal connected to the second terminal of first resistor R1 and the collector terminal of third transistor Q3, and a collector terminal connected to first adder-subtracter 36. A second resistor R2 has a first terminal connected to the collector terminal of third transistor Q3 and to the emitter terminal of fourth transistor Q4. A fifth transistor Q5 has an emitter terminal connected to a second terminal of second resistor R2, a base terminal connected to the base terminal of fourth transistor Q4, and a collector terminal connected to its base terminal. A fourth resistor R4 has a first terminal connected to the emitter terminal of third transistor Q3 and its other terminal connected to the collector terminal of fifth transistor Q5. A third resistor R3 has one terminal connected to the second terminal of fourth resistor R4 and the collector terminal of fifth transistor Q5. A first transistor Q1 has an emitter terminal connected to the other terminal of third resistor R3 and a base terminal connected to its own collector terminal. The collector terminal of first transistor Q1 produces current ip3 to the collector terminal of second transistor Q2.

The operation of the feedback control system for an electronic ballast will now be explained The operation of the electronic ballast will be described first.

Figure 1:
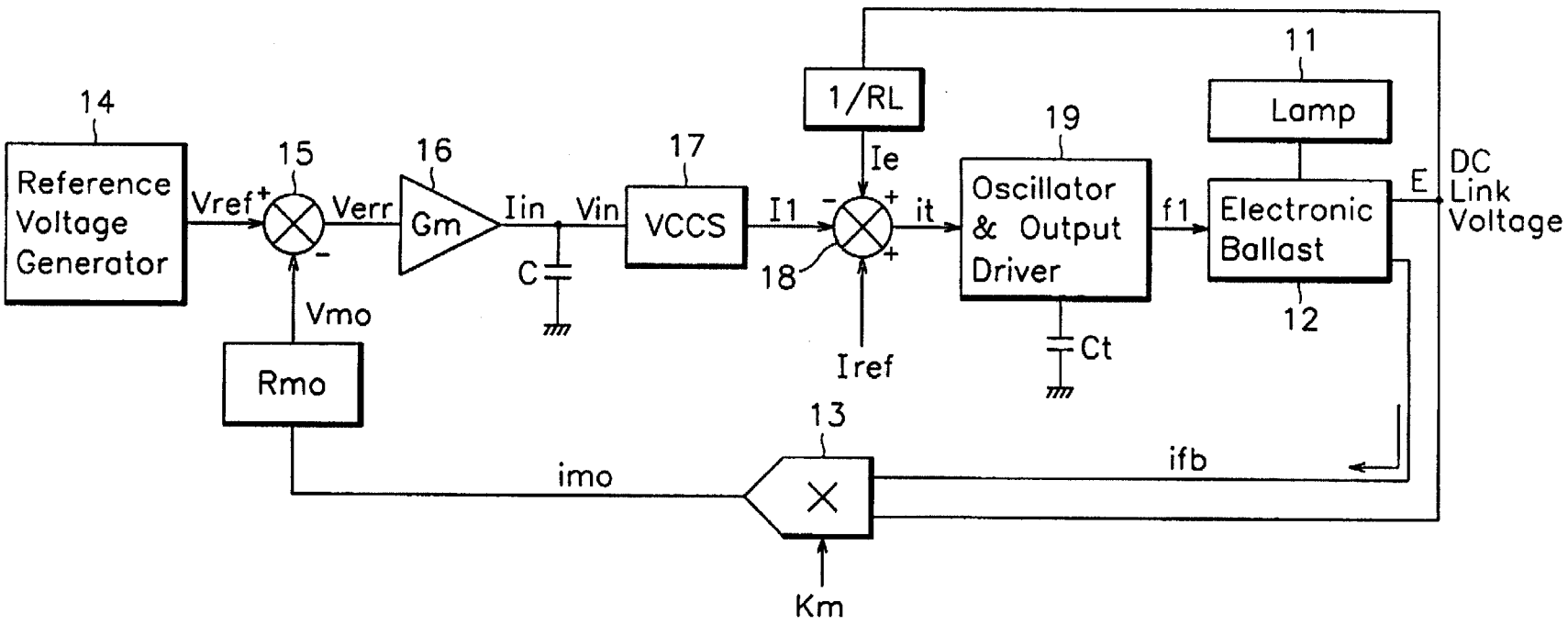
FIG. 1 (Prior Art)
FIG. 1 is a block diagram illustrating a conventional feedback control system for electronic ballast.
Figure 2:
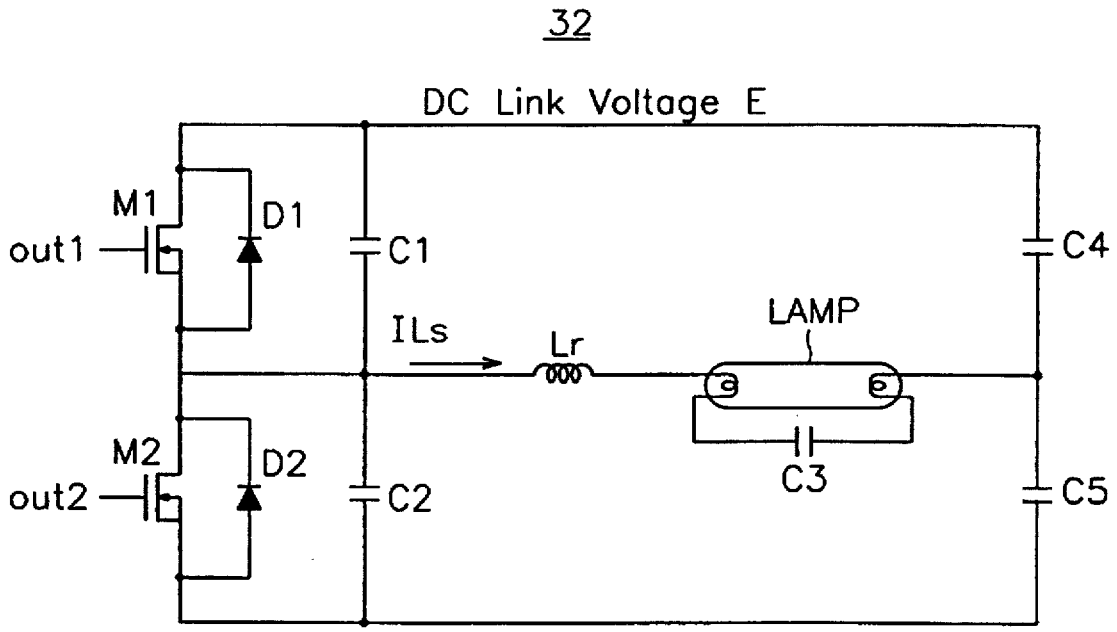
FIG. 2 is a block diagram illustrating an electronic ballast applied to a feedback control system according to a preferred embodiment of the present invention.

FIG. 2 is a block diagram illustrating an electronic ballast feedback control system, according to the preferred embodiment of the present invention.

As shown in FIG. 2, electronic ballast 32 is an LC resonant converter. Its switching frequency is characteristically inversely proportional to an input voltage when the switching frequency is controlled higher than the LC (i.e., a composition of Lr and C(C1, C2, C3, C4, C5)) resonant frequency. Accordingly, a switching frequency fP during the lamp preheating period should be relatively higher than frequency f0 at 100% input power for maintaining discharge.

In the preferred embodiment of the present invention, the frequencies preheating, temporary lamp discharge, and maintaining discharge are supplied on the basis of the feedback control. Thus, the lamp 31 is controlled.

FIG. 3 is a block diagram illustrating a feedback control system according to the preferred embodiment of the present invention and the operation of the electronic ballast feedback control system according to the preferred embodiment of the present invention will now be explained.

Current ifb, which electronic ballast 32 for controlling current produced to the lamp 31 consumes, and DC link voltage E are fed back to and combined by multiplier 33. The soft start controller 35 receives signal Vcs produced by time controller 34 in proportion to the preheating and discharge time periods of the lamp 31 and outputs a signal ip necessary for the preheating and discharge periods of the lamp 31. The first adder-subtracter 36 adds the output ip from the soft start controller 35 and an output (imo=

Km*ifb*E) from the multiplier 33 to arrive at imol (imol=imo+ip). The value imol passes through the resistor block Rmo and produces an output value Vmo. The second adder-subtracter 38 adds or subtracts the output value Vmo, based on an output Verf from reference voltage generator 37.

The output Vmo from resistor block Rmo is controlled so as to be equal to the output Vref from reference voltage generator 37 by changing feedback output values ifb and E coming from electronic ballast 32. Accordingly, if the output current ip from soft start controller 35 is increased, the output current imo from multiplier 33 is reduced in first adder-subtracter 36. If the DC link voltage E is set, the feedback current ifb is reduced. The reduction of the feedback current ifb means that the frequency f1 is controlled to reduce the power consumption of electronic ballast 32.

The change of the output from soft start controller 35 is applied to the preheating of lamp 31. If the output current ip from soft start controller 35 is increased, thereby reducing feedback current ifb, lamp 31 is preheated while lamp 31 is not discharged. After a predetermined lamp preheating time, output current ip from soft start controller 35 is reduced, such that feedback current ifb is controlled to be at a level necessary for lamp discharge and such that output current ip from soft start controller 35 reaches zero during the lamp discharge maintenance period.

Next, the added or subtracted voltage (Verr=Vref-Vmo) produced by second adder-subtracter 38 is amplified to current Iin by error amplifier 39 having transconductance Gm. The amplified current Iin is integrated to voltage Vin by capacitor C. The voltage Vin output therefrom is converted to current I1 through voltage controlled current source VCCS 40. The third adder-subtracter 41 adds current I1, current Ie fed forward from DC link voltage E of electronic ballast 32, and reference current Iref.

Total current (it) output from third adder-subtracter 41 is charged to capacitor Ct in oscillator and output driver 42, thereby determining control frequency f1 the electronic ballast 32.

The frequency f1 determines the input voltage to electronic ballast 32, and the determined input voltage is proportional to current ifb, thereby making feedback control possible.

As described above, periods for lamp preheating, discharge and discharge maintenance are continually fed back, thereby optimally controlling the electronic ballast.

FIG. 4 is a waveform chart illustrating resonant current and lamp current soft-started from the lamp preheating period to the lamp discharge maintenance period of the lamp by compulsory control of frequency in an open-loop state, according to the preferred embodiment of the present invention.

A reference mark iLa on the vertical axis indicates current amount during the lamp preheating period, the reference mark iLc indicates current amount during the contemporary lamp discharge period, and the reference mark iLb indicates current amount for determining input power during the lamp discharge maintenance period.

As a result, a current flow from the preheating period to the discharge maintenance period follows the basic current flow illustrated in FIG. 4, which is due to the characteristics of the lamp.

FIG. 5 is a circuit diagram illustrating a soft start controller in a feedback control system according to the preferred embodiment of the present invention.

Figure 6:
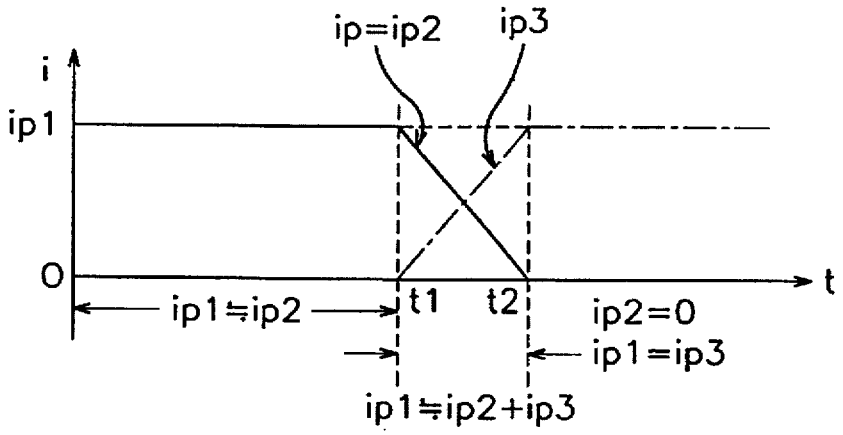
FIG. 6 is a schematic illustration of current flow of a soft start controller in a feedback control system according to the preferred embodiment of the present invention.

FIG. 6 is a schematic illustration of current flow of a soft start controller in a feedback control system according to the preferred embodiment of the present invention.

FIG. 5 is a circuit diagram for the output current ip from the soft start controller 35, which is input to the first adder-subtracter 36 to obtain the current flow illustrated in FIG. 6.

When emitter current ip1 from third transistor Q3 is determined by an ip bias current inputted to the base terminal of third transistor Q3, the output Vcs from time controller 34 becomes great in proportion to time and becomes almost equal to base voltage Vr2 of fourth transistor Q4 and fifth transistor Q5. The second transistor Q2 is therefore turned ON. This operation corresponds to a time t1 which is an end point of the lamp preheating period or a start point of the lamp discharge period.

After the time t1, collector current ip3 from first transistor Q1 becomes great proportionally, and collector current ip2 from fourth transistor Q4 becomes less proportionally, as illustrated in FIG. 6.

When collector current ip3 from first transistor Q1 is equal to emitter current ip1 from third transistor Q3, output current ip from soft start controller 35 becomes zero. This operation corresponds to a time t2 which is an end point of the discharge period or a start point of the discharge maintaining period.

The first resistor R1 determines a slope of the current change at the times t1 and t2. The greater the value of resistor R1, the less steep the slope of current is.

Figure 7:
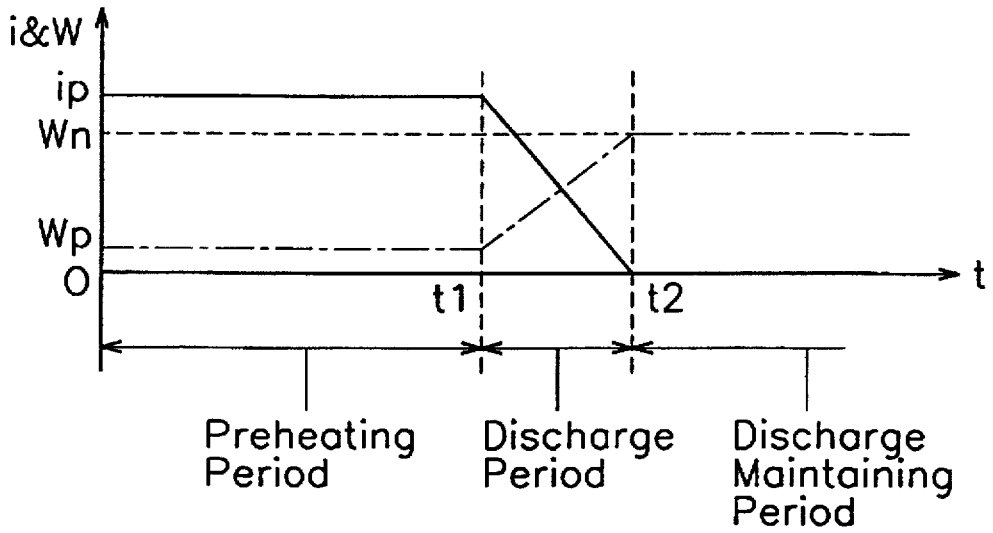
FIG. 7 is a schematic illustration of current control and power change by current control of a soft start controller in a feedback control system according to the preferred embodiment of the present invention.

FIG. 7 is a schematic illustration of current control and power change by current control of the soft start controller according to the preferred embodiment of the present invention.

If the output current ip from soft start controller 35 is used as preheating current and the whole system is controlled, the power of electronic ballast 32 is controlled to be Wp. If the discharge period begins after the preheating period passes, the preheating current is reduced to a negative slope and on the contrary, the power of electronic ballast 32 is increased to a plus slope.

At this time, controlling the current during the discharge period to have a negative slope is for sufficiently supplying temporary discharge power to lamp 31.

When the preheating current becomes zero, the preheating and discharge periods go by and the discharge maintenance period begins. The power at this time is controlled to be the best control power Wn of electronic ballast 32.

Figure 8:
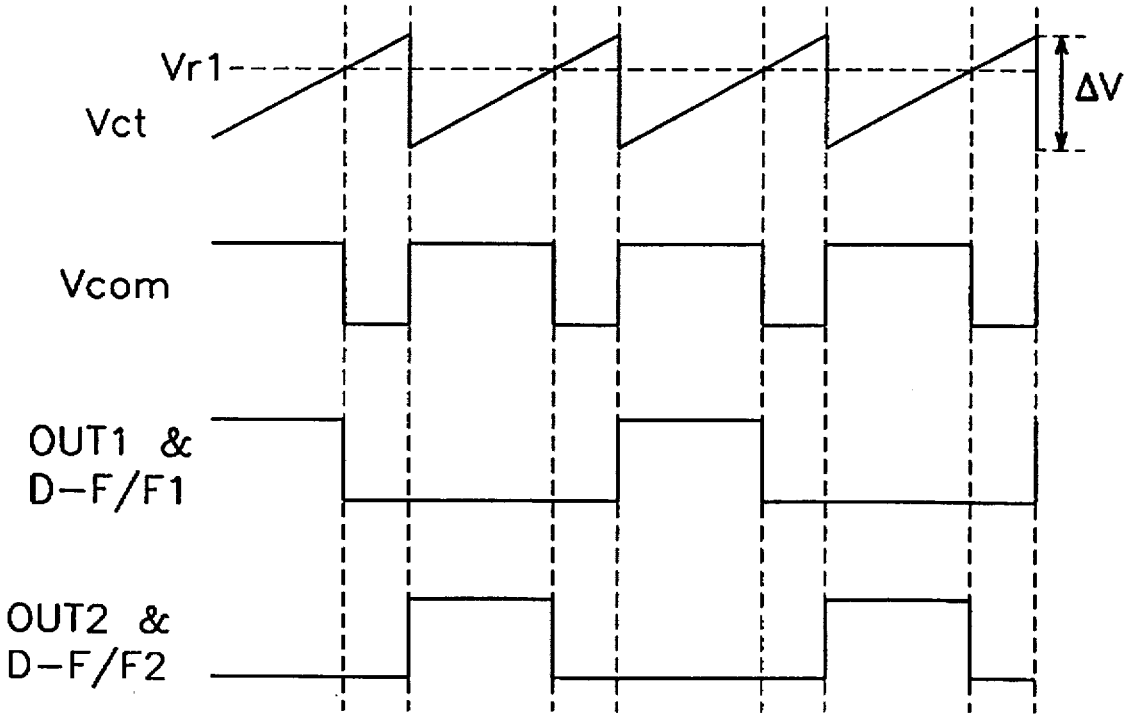
FIG. 8 is a waveform chart illustrating a signal of an oscilloscope and output driver in a feedback control system according to the preferred embodiment of the present invention.

FIG. 8 is a waveform chart illustrating a signal of the oscillator and output driver in a feedback control system according to the preferred embodiment of the present invention.

The output (it) from third adder-subtracter 41 is proportional to the output f1 from oscillator and output driver 42. The output (it) from third adder-subtracter 41 and output f1 from oscillator and output driver 42 can be expressed according to V of a saw-tooth wave produced from the capacitor Ct in oscillator and output driver 42 by the following equation 1.

$$2*f1=it/(Ct*\Delta V) \quad \text{(Equation 1)}$$

The frequency f1 for controlling electronic ballast 32 is the frequency of a dual output and is half the saw-tooth wave.

The reference mark Vct in FIG. 8 designates a voltage waveform produced from capacitor Ct in oscillator and output driver 42, and Vr1 is the internal comparing potential of oscillator and output driver 42.

An output from an internal comparator is represented by Vcom according to the internal comparing potential, Vr1 and Vcom is divided into D-flip-flop 1 and D-flip-flop 2 by an internal D-flip-flop.

The divided D-flip-flop 1 and D-flip-flop 2 are produced to signals OUT1 and OUT2 for driving electronic ballast 32 finally, and each output frequency of signals OUT1 and OUT2 is f1.

As described above, feedback can be controlled stably in spite of the irregular characteristics of the lamp load, energy can be saved and the life of the lamp can be extended by providing a feedback control system for an electronic ballast which can control stably the frequency for lamp preheating, temporary lamp discharge and lamp discharge maintenance.

The above-mentioned effect of the preferred embodiment of the present invention can be applied to all the products using an electronic ballast.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An illumination device including an electronic ballast and a feedback control system, comprising:

a lamp;

an electronic ballast for controlling lamp preheating, temporary lamp discharge, and lamp discharge maintenance, and for producing first and second signals for controlling feedback;

a multiplier for receiving and multiplying said first and second signals from said electronic ballast, thereby producing an output signal;

a time controller for producing a signal proportional to a lamp preheating time period and a lamp discharge time period;

a soft start controller for receiving said signal from said time controller and producing an output signal controlling a lamp preheating period and a lamp discharge period, said soft start controller including:

a second transistor having a base terminal for receiving said signal from said time controller;

a first resistor having a first terminal connected to an emitter terminal of said second transistor;

a third transistor having a collector terminal connected to a second terminal of said first resistor, a base terminal arranged to receive an ip bias current, and an emitter terminal for producing a first current;

a fourth transistor having an emitter terminal connected to said second terminal of said first resistor and said collector terminal of said third transistor, and a collector terminal connected to said first adder-subtracter;

a second resistor having a first terminal connected to said collector terminal of said third transistor and to said emitter terminal of said fourth transistor;

a fifth transistor having an emitter terminal connected to a second terminal of the second resistor, a base terminal connected to a base terminal of the fourth transistor, and a collector terminal connected to said base terminal of said fifth transistor;

a fourth resistor having a first terminal connected to said emitter terminal of said third transistor, and a second terminal connected to said collector terminal of said fifth transistor;

a third resistor having a first terminal connected to said second terminal of said fourth resistor and said collector terminal of said fifth transistor; and a first transistor with an emitter terminal connected to a second terminal of said third resistor, a collector terminal, and a base terminal connected to said collector terminal of said first transistor, said collector terminal of said first transistor being arranged to pass a current to said collector terminal of said second transistor;

a first adder-subtracter for adding or subtracting said output signal from said multiplier and said output signal from said soft start controller;

a reference voltage generator for producing a reference voltage for determining an input voltage to said electronic ballast;

a second adder-subtracter for adding or subtracting an output signal produced by said first adder-subtracter passed through a resistor, and said reference voltage from said reference voltage generator;

an error amplifier for amplifying an output signal produced by said second adder-subtracter;

a capacitor for integrating an output current signal produced by said error amplifier so as to convert it into a voltage;

a voltage controlled current source (VCCS) for receiving said voltage from said capacitor and converting it into a current;

a third adder-subtracter for adding or subtracting said current from said VCCS, a reference current, and a signal produced by said electronic ballast passed through a resistor, thereby obtaining a resultant output current; and an oscillator and output driver including an internal capacitor which is arranged so as to be charged by an output current from said third adder-subtracter, thereby determining a control frequency supplied to said electronic ballast.

2. The device of claim 1, wherein said second transistor is constructed and arranged to be turned ON at a time at which lamp preheating ends and lamp discharge begins when said signal from said time controller increases relative to time and approaches a voltage at said base terminals of said fourth and fifth transistors.

3. The device of claim 1, wherein said output signal from said soft start controller becomes zero at a time at which lamp discharge ends and lamp discharge maintenance begins when a collector current of said first transistor is equal to an emitter current of said third transistor.

4. The device of claim 1, wherein a collector current of said first transistor increases and a collector current from said fourth transistor decreases between a beginning and an end of lamp discharge.

5. The device of claim 1, wherein a rate of change of a current is controlled according to said first resistor between a beginning of lamp discharge and an end of lamp discharge, wherein a resistive value of said first resistor is inversely proportional to said rate of change of said current.

* * * * *